United States Patent [19]

Ebeling et al.

[11] Patent Number: 4,823,520

[45] Date of Patent: Apr. 25, 1989

[54] GRANULAR TERMITE BARRIER

[76] Inventors: Walter Ebeling, 10659 Rochester Ave., Los Angeles, Calif. 90024; Charles F. Forbes, 7343 Via Lorado, Rancho Palos Verdes, Calif. 90274

[21] Appl. No.: 63,582

[22] Filed: Jun. 17, 1987

[51] Int. Cl.[4] ..... A01M 1/20

[52] U.S. Cl. ..... 52/101; 52/742

[58] Field of Search ..... 52/101, 515, 741, 742

[56] References Cited

PUBLICATIONS

Journal of Economic Entomology, May 21, 1957, p. 690.

*Primary Examiner*—John E. Murtagh

*Attorney, Agent, or Firm*—Donald D. Mon

[57] ABSTRACT

A method of protecting a foundation wall from termites in which a barrier of sand of granule sizes which bar the passage of termites is placed contiguous to the wall. An impermeable structural barrier is embedded in the sand with a projecting upper edge. A concrete cap is poured atop the sand the cover it and encapsulate the upper edge of the barrier.

10 Claims, 1 Drawing Sheet

GRANULAR TERMITE BARRIER

FIELD OF THE INVENTION

This invention relates to barriers through which termites cannot pass.

BACKGROUND OF THE INVENTION

Subterranean termites enter a wooden structure through holes and cracks in foundations and walls. The art is replete with techniques to prevent their entry. Metal flashings, concrete stem walls that rise above grade, and sealants to close holes and cracks are widely-encountered examples.

The better known techniques are not usually long-lived. Foundations, for example, can and do crack, enabling the termites to enter the structure. Heaving of the ground or growth of roots often create voids through which the termites pass. There remains a need for an inexpensive, easily installed barrier which can withstand disruptive forces, discourage the entry of roots through it, and prevent the passage of termites.

It is known that termites cannot pass through barriers of sand whose particles are of certain sizes. It appears that some sizes are too large to be moved aside by the termites or seized by their mandibles and carried away, and that certain sizes are not so large as to leave spaces through which the termites can pass. This type of barrier is disclosed in Journal of Economic Entomology Vol. 50, No. 5, pp 690–692 Oct. 1957 by Walter Ebeling and Roy J. Pence. The first-named author in this article is one of the applicants in the instant patent application.

The extermination industry has long relied on insecticides applied as sprays or streams. These are very cost effective, and over the years have not caused much objection. However, as awareness has grown about the potentially harmful effects of insecticides, resistance has arisen to their continued use, especially by chemically-sensitive persons.

In view of this increased awareness, it is surprising that with the advantages offered by the process described in the article, there has been no commercial use made of this technique, at least to the knowledge of the present applicants. Upon relfection, the applicants have concluded that it has suffered fromlack of a simple method of application, and also from means to keep the barrier in place and in conformity with adjacent structures once it is applied. If it washes away, or ultimately cracks or fails to conform to the structure it protects, then its protective value is lost.

It is an object of this invention to provide a conveniently installed barrier to passage of termites, and methods and constructions which assure its long-lived effectiveness.

BRIEF DESCRIPTION OF THE INVENTION

This invention comprises a barrier of sand consisting of particles of suitable size to prevent termites from passing therethrough. It comprehends application of the sand on upwardly facing areas by means of fluidized pumping.

On side-facing areas, retainer means is inserted in the sand to prevent its migration, which also provides a secondary barrier, and caps are applied to protect the upper and lower margins of the sand.

The above and other features of this invention will be fully understood from the following detailed description and the accompanying drawings, in which:

DETAILED DESCRIPTION OF THE INVENTION

Figure 1:
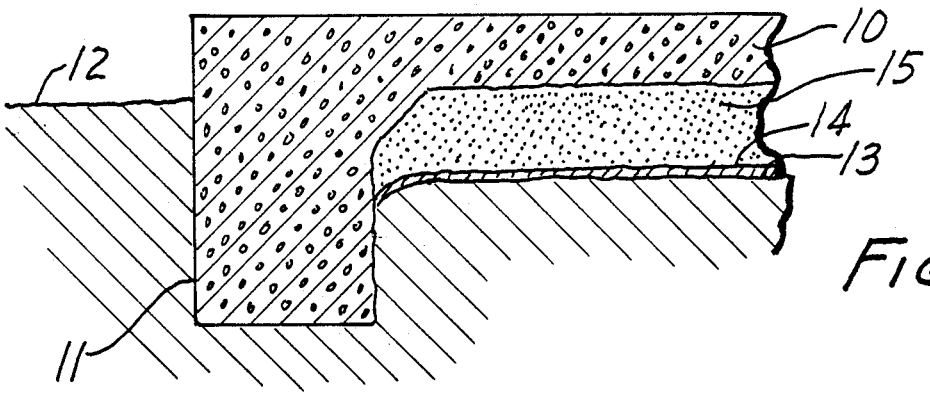
FIG. 1 is a cross-section showing the invention beneath a poured concrete slab.

FIG. 1 shows a concrete slab 10 with a stem wall 11 poured on and into the ground. Outside the slab the ground is at grade level 12. Beneath the slab the top surface 13 of the ground is below grade, although it could be at any suitable elevation. Before it is poured, a vapor barrier 14 of impermeable sheet material such as organic plastic is preferably laid down. This is a pretreatment step. This barrier will resist root growth. Then a layer 15 of sand as described elsewhere herein is laid atop the sheet. The slab is next poured atop it. Notice that it also bears against the stem wall.

The sand now forms a barrier between the ground inside the foundation wall and beneath the slab. If there is to be drift of the sand, it will still tend to cover the top of the ground, and continue to bear against the inside of the stem wall. The dryness of the sand provides an unfriendly place for roots to grow, and there is no likelihood of channeling of the sand. Accordingly, layer 15 provides protection against termites for any structure which might be in contact with the slab, and especially since cracks may have developed in the slab. It is also possible to apply salt to the ground before applying the sand blanket, further to repress the growth of roots.

Figure 2:
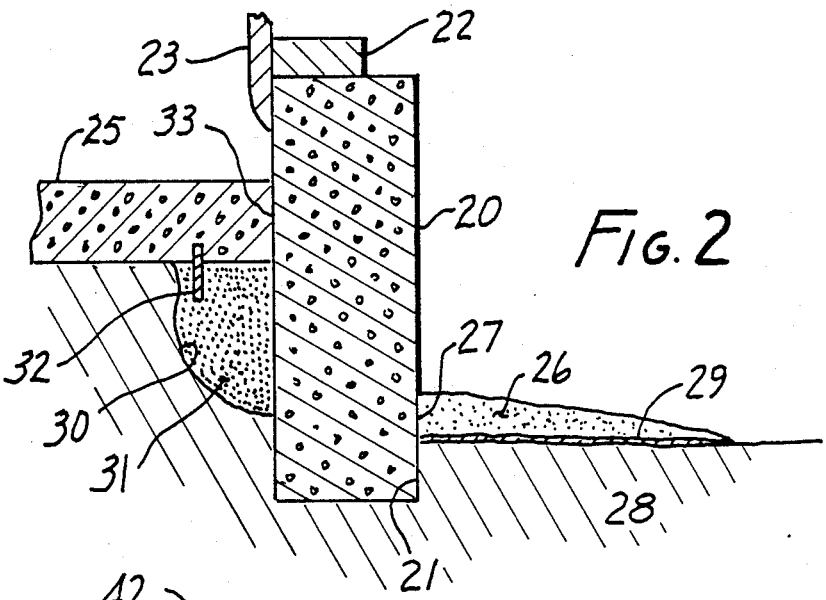
FIG. 2 is a cross-section showing the invention protecting both the inside and the outside of a concrete foundation stem wall.

FIG. 2 shows a conventional concrete foundation 20 poured into a trench 21 in the ground 28. Wooden framing 22 is schematically shown atop the wall, and a plaster coat 23 is schematically shown, applied to the stem wall and to the framing or wall structure. The framing and wall structure are above grade.

A slab 25 such as a patio deck is shown poured adjacent to the foundation. An objective of this invention is to prevent subterranean termites from building their tubes up to the framing. This is accomplished on the inside of the foundation by applying a layer 26 of sand so that it rises along surface 27, and also extends horizontally on the ground 28. A sheet like vapor barrier 29 can be placed beneath this layer of sand but usually will be unnecessary. Conformity is assured by the inherent tendency of the sand to flow within its angle of repose. Earth movement will merely cause it to slump or consolidate somewhat. Coring and cracking are not contemplated. Contact with both the stem wall and with the ground are continously assured.

The treatment at the outside is somwewhat different. The inside region is expected to stay dry. Inside, there is no substantial likelihood of migration away from the protected surfaces to the extent that the protection might be frustrated. However, the outside is subjected to forces and conditions which could lead to sufficient migration and separation such as could frustrate the protection. Accordingly, a trench 30 is dug adjacent to the outside of the stem wall and is filled with sand 31.

Before the slab 25 is poured, a metal barrier 32 is pressed into the sand, and the concrete is deposited atop the sand and enclosingthe metal barrier, which holds it in place. The metal barrier prevents a termite from crawling along the top of the sand after the sand has settled below it. It also reduces the tendency of the sand to slump away from the wall. Thus the combination of the sand and the metal barrier protects the joinder 33 between the slab and the foundation. The sand itself protects the outside face of the stem wall. The two layers of sand thereby fully protect the stem wall from incursions of termites.

Figure 3:
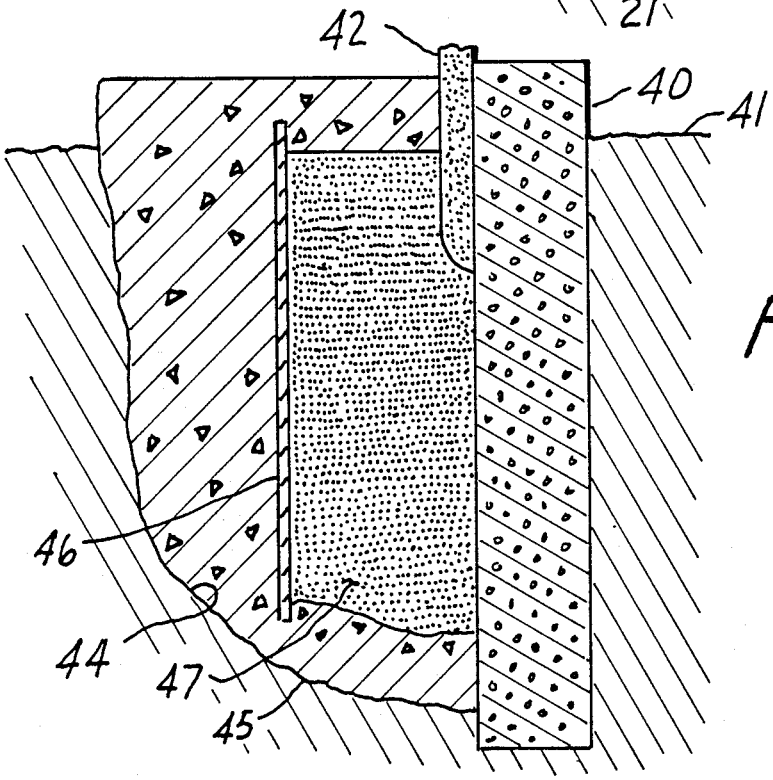
FIG. 3 is a cross section showing the invention protecting the joinder of a plaster surface with a concrete foundation.

FIG. 3 shows another useful construction. In this construction a concrete stem wall 40 rises above grade 41, and has a layer of stucco plaster 42 extending above and below grade. The objective of this embodiment is to protect the inerface 43 between the plaster and the foundation from subterranean termites.

For this purpose a trench 44 is formed, and in its there is poured a concrete bulb 45. A metal barrier 46 is pressed into the bulb. A layer 47 of sand is poured into the trench between the foundation and the metal barrier. The barrier projects above the sand which may have salt applied to it or mixed in it, and a concrete cap is poured to fill the trench and also atop the sand and to enclose over the top of the metal barrier, thereby forming a cap. The metal barrier assures that termites cannot pass over the top of the sand if the sand settles or slumps. It also assures that sand will be held against th outside of the foundation. Termites therefore cannot travel through the sand or along the foundation wall. The outside wall of the foundation is thereby completely protected. Inside protection (not shown) could be provided as in FIG. 2, if desired.

The application of the sand to broad areas and in regions beneath a house can be troublesome. It is necessary that full coverage be provided. However, tossing the sand from a shovel is unlikely to provide this result. Accordingly, fluidized transport of the sand is preferred. Sand is preferably conveyed in a fluid carrier stream such as air. A relatively slow flow rate is preferred, so as not to stir up the sand after it is deposited. For the trenches, shoveling in the sand is a suitable technique.

The cited publication is incorporated by reference in its entirety, especially for its teaching of suitable sand for use with this invention. It is preferred that the sand be readily procured, and need not be screened to size. A standard sand of known characteristics is preferred. Also it is preferred that it need not be compacted in place. 10 to 16 mesh sandblast grits are examples, a range encompassed in a sand known as "12 grit". If compaction is tolerable, then sand mixtures known as "C6 to 16" are useful. Not more than about 5% of grains that would not pass the 16 mesh screen should be included and not more than about 5% which would be retained on a 6 mesh screen should be included. This tolerance enables commercially crushed and graded materials to be used without excessive grading by successive screenings.

Beach sand, crushed cinders, and the like, are all suitable for use in this invention any many commercial grades have distributions of sizes useful in the invention.

This invention thereby provides techniques and constructions for attaining the benefits described in the cited publication.

This invention is not to be limited by the embodiments shown in the drawings and described in the descriptions, which are given by way of example and not of limitation, but only in accordance with the scope of the appended claims.

We claim:

1. The method of protecting the foundation of a structure from termite incursion, comprising:

applying adjacent to and in contiguous contact with said foundation a depth of sand having particle sizes and interstitial sapces such that a termite cannot move the particles aside or pass through said spaces, said depth of sand having an upper surface, embedding an impermeable structural barrier in said sand with an edge portion rising above said upper surface, said barrier confining said sand to contact with said foundation, and pouring concrete atop said upper surface and completely over said upper edge, whereby to form a solid barrier against the passage of insects along the said upper surface.

2. A method according to claim 1 in which said concrete is poured as a slab.

3. A method according to claim 1 in which a layer of said sand is also laid atop the earth on the other side of said foundation in contact with both the earth and with the foundation on said other side.

4. A method according to claim 3 in which a fluid impermeable vapor barrier is laid between the sand and the earth on said other side of the foundation before pouring said concrete.

5. A method according to claim 3 in which said sand is applied on said other side by fluid transport means.

6. A termite-protected foundation wall having a trench contiguous thereto, and in said trench layer of sand having particle sizes and interstitial spaces such that a termite cannot move the particles aside or pass through said spaces, said sand bearing against and contacting said foundation wall and having an upper surface, an impermeable structural barrier confining said sand to make said contact with said foundation wall, said barrier having an edge portion rising above said upper surface and a concrete cap encapsulating said edge portion of said barrier and capping said sand.

7. A wall according to claim 6 having on its other side a layer of such sand bearing against it and extending away from it.

8. A wall according to claim 7 in which said second mentioned sand lays atop the ground.

9. A wall according to claim 7 in which a fluid-impermeable vapor barrier is laid beneath said second-mentioned sand and the ground.

10. A wall according to claim 6 in which a layer of plaster is applied thereto, which plaster layer extends downwardly into the sand.

* * * * *